United States Patent [19]

Henderson et al.

[11] Patent Number: 4,533,778

[45] Date of Patent: Aug. 6, 1985

[54] TRACTION FLUID LUBRICANTS DERIVED FROM MINERAL OIL

[75] Inventors: Harry E. Henderson, Sarnia; Clinton R. Smith, Camlachie, both of Canada

[73] Assignee: Imperial Oil Limited, Toronto, Canada

[21] Appl. No.: 453,730

[22] Filed: Dec. 27, 1982

Related U.S. Application Data

[63] Continuation-in-part of Ser. No. 226,628, Jan. 21, 1981, abandoned.

[51] Int. Cl.[3] ..... C10M 1/04

[52] U.S. Cl. ..... 585/13; 208/18; 208/19; 585/1; 585/26

[58] Field of Search ..... 208/18, 19; 585/1, 13, 585/26; 74/200, 214, 215

[56] References Cited

U.S. PATENT DOCUMENTS

| | | | |
|---|---|---|---|
| 3,411,369 | 11/1968 | Hammann et al. | 74/200 |
| 3,419,497 | 12/1968 | Rocchini et al. | 252/63 |
| 3,440,894 | 4/1969 | Hammann et al. | 74/200 |
| 3,595,796 | 7/1971 | Duling et al. | 252/73 |
| 3,598,740 | 8/1971 | Duling et al. | 252/73 |
| 3,714,021 | 1/1973 | Takahashi et al. | 208/14 |
| 3,775,503 | 11/1973 | Driscoll et al. | 260/676 |
| 3,843,537 | 10/1974 | Duling et al. | 252/59 |
| 3,912,617 | 10/1975 | Mills et al. | 208/14 |

FOREIGN PATENT DOCUMENTS 1525174 9/1978 United Kingdom .

*Primary Examiner*—Thomas A. Waltz
*Attorney, Agent, or Firm*—Eugene Zagarella

[57] ABSTRACT

A traction fluid having a lubricant basestock comprising a selected mineral oil composition containing a saturate fraction having a significant portion made up of multiring components of at least three rings and an aromatic fraction which comprises at least 15% by weight of said composition and contains at least 40% by volume of multiring components.

14 Claims, No Drawings

TRACTION FLUID LUBRICANTS DERIVED FROM MINERAL OIL

CROSS-REFERENCE TO RELATED APPLICATION

This application is a continuation-in-part of Ser. No. 226,628 filed Jan. 21, 1981, now abandoned.

BACKGROUND OF THE INVENTION

This invention relates to selected mineral oil compositions which are useful as lubricant basestocks in traction fluids. More particularly, the invention is directed to a traction fluid having a lubricant basestock which comprises mineral oil compositions containing a saturate fraction having a significant portion made up of multiring components of at least three rings and an aromatic fraction which comprises at least about 15% by weight of said composition and which fraction contains at least 40% by volume of multiring aromatic components.

Traction fluid is a term used to identify a class of lubricants that give superior performance in traction drives. A traction drive transfers force from one rotating shaft to another through a rolling contact. Efficient transfer requires that a minimum amount of slippage occurs. This property is measured by the traction coefficient which is defined as force transmitted divided by the normal force which keeps the rolling members in contact.

The coefficient of traction as defined above, has been one of the prime measurements used in defining useful traction fluids. Various studies have been made attempting to define the type of structures associated with higher traction properties. Thus, some of the more suitable structures which have been reported include U.S. Pat. No. 3,411,369 which discloses fused, saturated carbon containing rings; U.S. Pat. No. 3,440,894, which discloses organic compounds containing a saturated carbon containing ring or an acyclic structure having at least three quaternary carbon atoms; U.S. Pat. Nos. 3,595,796 and 3,598,740 disclose the use of selected naphthenes and branched paraffins; and U.S. Pat. No. 3,843,537 discloses the use of naphthenes, partially saturated precursors of naphthenes, hydrorefined mineral oils, polyolefins and branched paraffins.

Generally, the structures defined in the literature as having good traction properties have not included aromatic constituents. This is exemplified by U.S. Pat. Nos. 3,595,796; 3,598,740 and 3,843,537 which indicate the general undesirability of aromatic unsaturation as it relates to traction properties and the need to limit aromatic content to very low levels.

SUMMARY OF THE INVENTION

Now in accordance with this invention it has surprisingly been found that selected mineral oil compositions which contain significant amounts of aromatic constituents are particularly useful as traction fluid lubricants.

More particularly, this invention is directed to a traction fluid having a lubricant basestock which comprises selected mineral oil composition containing a saturate fraction having at least about 35% by volume of multiring components of at least three rings and an aromatic fraction which comprises at least about 15% by weight of said composition and wherein the weight ratio of aromatic fraction to saturate fraction is at least about 0.2:1, said aromatic fraction containing at least about 40% by volume of multiring components having two or more rings at least one of which is an aromatic ring, said traction fluid having a viscosity of at least about 40 cSt at 30° C. and a Traction Index of at least about 0.65.

Another embodiment of this invention relates to the method of operating a traction drive comprising the improvement of using the traction fluid of this invention which contains a significant amount of aromatic constituents and includes the saturate and aromatic fractions as defined herein.

DETAILED DESCRIPTION OF THE INVENTION

The ability to ascertain the surprising attributes of aromatic constituents in traction fluids was in part the result of a newly-developed technique for evaluating traction properties. This technique involved development of a traction index which is based on the rolling torque generated and the amount of slippage found in the rolling contact. Further details of this technique will be described in detail later on in the specification.

The mineral oil compositions on which the traction fluids of this invention are based are any of the commonly available petroleum basestock materials which comprise a range of different hydrocarbons of naphthenic, aromatic and paraffinic content. The selected mineral oil compositions are obtained from the starting mineral oils by separation into fractions having specified saturated and aromatic portions as will hereinafter be defined. Generally, this fractionation will be made by a technique such as thermal diffusion, a known separation procedure which is described for example in "Composition and Oxidation of Petroleum Fractions" by G. E. Cranton in Thermochemica Acta, 14 (1976) 201-208. Other techniques which can be used to produce the desired fractions can also be used.

The selected traction fluids of this invention contain lubricant basestock materials which are mineral oils selectively fractionated to yield a composition which contains a saturate fraction and an aromatic fraction. Generally the weight ratio of aromatics to saturates will be at least about 0.2:1, preferably at least about 0.3:1 and more preferably at least about 0.4:1. The saturate fraction will generally have a significant portion, i.e. greater than about 35% by volume, and preferably greater than about 50%, made up of multiring components of at least three rings. More particularly, the saturate fraction will have a volume ratio of multiring (three or more rings) to 1-2-ring components of at least about 0.5:1, preferably at least about 1:1 and more preferably at least about 2:1. The aromatic fraction will generally comprise at least about 15% by weight of the composition, preferably at least about 20% and more preferably at least about 25% by weight. The aromatic fraction will contain at least about 40% by volume of multiring components having two or more rings, at least one of which is an aromatic ring, preferably at least about 60% and more preferably at least about 80% by volume. Generally, the saturate fraction will comprise from about 20 to about 85% by weight of the basestock composition and more preferably from about 30 to about 80% by weight.

The multiring portion of the aromatic fraction is generally comprised of naphthalenes, acenaphthene, fluorenes, phenanthrenes, mononaphthene benzenes and dinaphtene benzenes. It is understood that branched or substituted ring components are also included in the defined aromatic fraction. The saturate fraction will generally be comprised of 5 and 6 membered ring structures having various branched substituents. Generally, both the saturate and aromatic fraction will be comprised of a mixture of compounds each containing about 6 to about 100 carbon atoms. Each fraction will generally contain a variety of branched substituents and may contain small amounts of sulfur and nitrogen content.

In addition to the lubricant basestocks of this invention, additives designed to enhance specific properties of the traction fluids can be added to the composition. Such additives include, for example, V.I. improvers, antiwear agents, corrosion inhibitors, antioxidants, dispersants, etc. Generally additive amounts of up to about 20%, preferably up to about 10% by weight of the fluid may be used in the traction fluids.

As indicated earlier, the ability to ascertain the surprising traction properties resulting from materials containing significant aromatic constituents was aided by a new technique for evaluating such traction properties. A traction index (TI) which is based on the rolling torque generated and the amount of slippage found in the rolling contact was formulated to rate the different fluid materials.

Table I shows the parameters used in rating the material and as defined therein:

$$TI = \frac{T_f + T_s + S_{5F} + \Delta S_r}{4}$$

with the different torque and slip factors used in ascertaining TI being further defined in said Table I.

The traction data was obtained on a modified Roxana four ball wear tester as described in ASTM D 2266-67. The traction tester used had a Brown modification consisting of a hydraulic cylinder which applied a normal load and an air bearing which allowed for accurate frictional measurements. Additionally, the tester had a machined pot which held a conforming race and allowed rolling contact to occur rather than the sliding contact required by the ASTM method (the bottom three balls in the four-ball pyramid were allowed to roll on a conforming race). This tester was evaluated as a means for determining the traction properties by selecting a series of materials whose coefficients of traction had been previously determined and measuring their traction properties on such a tester. As indicated in Table II, the Traction Index (TI) gave a linear correlation with literature traction coefficients and was therefore a valid method of evaluating traction properties.

The traction fluids of this invention generally will have a viscosity of at least about 40 cSt at 30° C., preferably at least about 50 cSt at 30° C. and a Traction Index, as described above, of at least about 0.65 and preferably at least about 0.75.

The fluids of this invention, as described herein, are particularly useful as the traction fluid lubricant in the operation of a traction drive.

Further details and illustrations of this invention will be found in the following examples.

EXAMPLE 1

A paraffinic Solvent 150 Neutral mineral oil having a viscosity of 12.3 cSt at 65° C., $n_D$ of 1.4756, and a VI (viscosity index as determined by ASTM D2270) of 90 was used as the feed material.

The feed material was fractionated using batch thermal diffusion in laboratory scale units of the vertical cylinder type with each column furnished with ten ports with a mean slit diameter of 0.03 cm. The total volume of each unit was 30 ml. The inner wall of the annulus was cooled by water to 57.2°-65.6° C. and the outer wall was electrically heated to 115.6°-137.8° C. Operation involved filling the column with feed, allowing a period of time (about 14 days) for separation and sampling the ports starting from the top. This was repeated until about 12 ml. was obtained for each fraction.

The resulting fractions were evaluated for traction properties and the results given in Tables III and IIIA.

EXAMPLE 2

A naphthenic Solvent 60 Neutral mineral oil having a viscosity 4.38 cSt at 65° C., $n_D$ of 1.4747 and a VI of 68 was used as the feed material and fractionated in the same manner as the sample in Example 1.

The resulting fractions were evaluated for traction properties and the results given in Table IV.

EXAMPLE 3

A paraffinic Solvent 60 Neutral mineral oil having a viscosity of 4.60 cSt at 65° C., $n_D$ of 1.4748 and a VI of 37 was used as the feed material and fractionated in the same manner as the sample in Example 1.

The resulting fractions were evaluated for traction properties and the results given in Table V.

These results show that the selected fractions identified in Tables III, IV and V are particularly suitable as traction fluids. Comparing these data to those of a current synthetic traction fluid (see Table II, Santotrac 50), shows that equivalent or better traction properties are achieved at comparable viscosities.

Information regarding the analyses of the different fractions tested can be found in Tables VI, VII and VIII.

TABLE I

PARAMETERS FOR RATING OILS BY TRACTION TESTER[1]

| Parameter | Symbol | Good Performance | Poor Performance | Rating Factor |
|---|---|---|---|---|
| Torque: 150 kg, 115 cm/sec, 65° C.(g-cm) | $T_{3000}$ | >220 | <150 | |
| Torque Factor, 150 kg | $T_F$ | 1 | 0 | $(T_{3000}-150)/70$ |
| Torque: 150 kg, 7.7 cm/sec, 65° C.(g-cm) | $T_{200}$ | >220 | <150 | |
| Torque Speed Dependence | $T_S$ | 1 | 0 | $(1 - (T_{200}-T_{3000})/200$ |
| % Slip: 5 kg, 192 cm/sec, 65° C. | $S_5$ | >2.5 | <1.0 | |
| % Slip Factor, 5 kg | $S_{5F}$ | 1 | 0 | $S_5/2.5$ |
| % Slip 50 kg, 192 cm/sec, 65° C. | $S_{50}$ | ~0 | >1.0 | |
| Slip Load Dependence | $\Delta S_R$ | 1 | 0 | $(S_5-S_{50})/S$ |
| Traction Index (TI) | | 1 | 0 | $\frac{T_F + T_S + S_{5F} + \Delta S_R}{4}$ |

[1]A good performance will give a TI of ≧1 while a poor performance will give a TI of ca. O.

TABLE II

DATA FOR CORRELATING TRACTION TESTER WITH LITERATURE

| Lubricant | Viscosity (cSt, 65° C.) | Traction Index | Traction Coefficient (at 102 cm/sec) |
|---|---|---|---|
| MCT 10 Base (Solvent 150 neutral) | 12.0 | 0.57 | ca. 0.045 |
| Santotrac 50 (Monsanto) | 12.8 | 1.11 | 0.095 |
| Oleic Acid | 9.7 | 0.22 | 0.036 |
| Ethylene Glycol | 4.1 | 0.15 | 0.007 |
| Cyclohexanol | 6.7 | 0.49 | 0.056 |
| Diethylene Glycol | 5.5 | 0.39 | 0.031 |
| Santotrac EP-2 | — | 1.16 | 0.108 |

TABLE IIIA

Additional Properties of Thermal Diffusion Fractions from Paraffinic Solvent 150 N

| Fraction No. | Viscosity (cSt) 30° C. | 40° C. | 75° C. | 100° C. |
|---|---|---|---|---|
| Feed | 48.0 | 30.8 | 9.25 | 5.10 |
| 3 | 21.2 | 14.57 | 5.70 | 3.53 |
| 6 | 46.0 | 29.37 | 8.80 | 4.96 |
| 7 | 78.0 | 45.25 | 11.60 | 6.10 |
| 8 | 190.0 | 94.75 | 16.80 | 7.59 |
| 9 | 765.0 | 324.20 | 39.50 | 15.23 |
| 10 | 1600.0 | 566.0 | 46.00 | 15.54 |

TABLE IV

PHYSICAL AND TRACTION PROPERTIES OF THERMAL DIFFUSION FRACTIONS FROM NAPHTHENIC SOLVENT 60 N

| Fraction No. | Physical Properties $n_D$ | Viscosity (cSt, 65° C.) | VI | Traction Properties $T_{200}$ (g-cm) | $T_{3000}$ (g-cm) | $S_5$ | $S_{50}$ | $T_F$ | $T_S$ | $S_{5F}$ | $\Delta_{SR}$ | TI | Additional Viscosity Data Viscosity (cSt) 30° C. | 40° C. | 75° C. | 100° C. |
|---|---|---|---|---|---|---|---|---|---|---|---|---|---|---|---|---|
| Feed | 1.4747 | 4.38 | 68.0 | 203.7 | 180.8 | 0.92 | 0.24 | 0.44 | 0.89 | 0.37 | 0.74 | 0.61 | 11.7 | 8.31 | 3.50 | 2.27 |
| 8 | 1.4898 | 5.70 | 15.0 | 198.8 | 183.6 | 1.15 | 0.18 | 0.48 | 0.92 | 0.46 | 0.84 | 0.68 | 19.0 | 12.75 | 4.50 | 2.72 |
| 9 | 1.5032 | 7.80 | −0.7 | 228.5 | 191.0 | 1.45 | 0.06 | 0.59 | 0.81 | 0.58 | 0.96 | 0.74 | 33.0 | 19.89 | 5.80 | 3.36 |
| 10 | 1.5172 | 14.30 | −64.3 | 196.2 | 196.4 | 2.95 | 0.04 | 0.66 | 1.01 | 1.18 | 0.99 | 0.96 | 92.0 | 47.94 | 10.00 | 4.88 |

TABLE V

PHYSICAL AND TRACTION PROPERTIES OF THERMAL DIFFUSION FRACTIONS FROM PARAFFENIC SOLVENT 60 N

| Fraction No. | Physical Properties $n_D$ | Viscosity (cSt, 65° C.) | VI | Traction Properties $T_{200}$ (g-cm) | $T_{3000}$ (g-cm) | $S_5$ | $S_{50}$ | $T_F$ | $T_S$ | $S_{5F}$ | $\Delta_{SR}$ | TI | Additional Viscosity Data Viscosity (cSt) 30° C. | 40° C. | 75° C. | 100° C. |
|---|---|---|---|---|---|---|---|---|---|---|---|---|---|---|---|---|
| Feed | 1.4748 | 4.60 | 37.0 | 204.9 | 175.4 | 0.80 | 0.36 | 0.36 | 0.85 | 0.32 | 0.55 | 0.52 | 13.3 | 9.23 | 3.65 | 2.30 |
| 7 | 1.4813 | 5.40 | 57.0 | 202.4 | 181.0 | 1.02 | 0.32 | 0.44 | 0.89 | 0.41 | 0.69 | 0.61 | 16.4 | 11.09 | 4.24 | 2.65 |
| 8 | 1.4932 | 6.75 | 21.0 | 207.3 | 187.1 | 1.22 | 0.12 | 0.53 | 0.90 | 0.49 | 0.90 | 0.71 | 24.0 | 15.52 | 5.30 | 3.09 |
| 9 | 1.5084 | 10.30 | −18.5 | 195.2 | 189.7 | 1.51 | 0.04 | 0.57 | 0.97 | 0.60 | 0.97 | 0.78 | 49.5 | 28.58 | 7.60 | 4.04 |
| 10 | 1.5212 | 20.50 | −49.1 | 198.6 | 196.6 | 3.93 | 0.04 | 0.67 | 0.99 | 1.57 | 0.99 | 1.06 | 159.0 | 78.03 | 13.50 | 6.19 |

(Monsanto)

TABLE III

PHYSICAL AND TRACTION PROPERTIES OF THERMAL DIFFUSION FRACTIONS FROM PARAFFINIC SOLVENT 150 N

| Fraction No. | Physical Properties $n_D$ | Viscosity (cSt, 65° C.) | VI | Traction Properties $T_{200}$ (g-cm) | $T_{3000}$ (g-cm) | $S_5$ | $S_{50}$ | $T_F$ | $T_S$ | $S_{5F}$ | $\Delta_{SR}$ | TI |
|---|---|---|---|---|---|---|---|---|---|---|---|---|
| Feed | 1.4823 | 12.3 | 89.0 | 192.0 | 188.5 | 1.06 | 0.60 | 0.55 | 0.98 | 0.42 | 0.43 | 0.60 |
| 3 | 1.4629 | 8.2 | 124.0 | 187.5 | 165.7 | 0.82 | 0.00[a] | 0.22 | 0.89 | 0.33 | 1.00 | 0.61[b] |
| 6 | 1.4800 | 11.8 | 89.0 | 191.4 | 186.3 | 0.98 | 0.60 | 0.52 | 0.97 | 0.39 | 0.39 | 0.57 |
| 7 | 1.4889 | 16.2 | 70.0 | 196.3 | 192.2 | 1.07 | 0.40 | 0.60 | 0.98 | 0.43 | 0.63 | 0.66 |
| 8 | 1.4998 | 25.2 | 10.6 | 195.1 | 200.8 | 1.43 | 0.04 | 0.73 | 1.03 | 0.58 | 0.97 | 0.83 |
| 9 | 1.5108 | 65.0 | 8.7 | 199.7 | 215.4 | 2.33 | 0.08 | 0.93 | 1.08 | 0.93 | 0.97 | 0.98 |
| 10 | 1.5163 | 82.0 | −118.7 | 199.5 | 229.7 | 2.88 | 0.07 | 1.14 | 1.15 | 1.15 | 0.98 | 1.11 |
| Other viscosity data for the different fractions shown in Table IIIA | | | | | | | | | | | | |

[a] $S_{100} = 0.20$.
[b] TI for $T_F$, $T_S$, $S_{5F} = 0.48$.

TABLE VI

ANALYSIS OF PARAFFINIC SOLVENT 150 N THERMAL DIFFUSION FRACTIONS[a]

| | Feed | Port #3 | Port #7 | Port #8 | Port #9 | Port #10 |
|---|---|---|---|---|---|---|
| Silica Gel Analysis | | | | | | |
| Saturates, wt. % | 80.6 | 90.7 | 75.3 | 71.4 | 68.4 | 66.0 |
| Aromatics, wt. % | 15.5 | 7.9 | 20.7 | 23.7 | 26.3 | 27.3 |
| Polar Compounds, wt. % | 3.9 | 1.4 | 4.0 | 4.9 | 5.3 | 6.7 |
| Recovery, wt. % | 100.0 | 100.0 | 100.0 | 100.0 | 100.0 | 100.0 |
| Mass Spec Analysis | | | | | | |
| Saturates (LV % on Saturates) | | | | | | |

TABLE VI-continued

ANALYSIS OF PARAFFINIC SOLVENT 150 N THERMAL DIFFUSION FRACTIONS[a]

| | Feed | Port #3 | Port #7 | Port #8 | Port #9 | Port #10 |
|---|---|---|---|---|---|---|
| Paraffins | 23.70 | 40.66 | 5.68 | 1.85 | 0.17 | 2.03 |
| 1-Ring | 26.96 | 40.81 | 27.10 | 14.43 | 0.00 | 7.56 |
| 2-Ring | 18.17 | 14.19 | 29.97 | 24.59 | 19.91 | 16.23 |
| 3-Ring | 10.95 | 2.19 | 19.83 | 22.23 | 20.63 | 18.11 |
| 4-Ring | 11.80 | 0.84 | 11.25 | 24.86 | 37.25 | 30.61 |
| 5-Ring | 5.16 | 0.16 | 3.35 | 8.09 | 14.33 | 15.37 |
| 6-Ring | 2.34 | 0.45 | 1.49 | 2.44 | 5.50 | 7.69 |
| Mono-aromatics | 0.92 | 0.71 | 1.32 | 1.50 | 2.22 | 2.39 |
| | 100.00 | 100.00 | 100.00 | 100.00 | 100.00 | 100.00 |
| Aromatics (LV % on Aromatics) | | | | | | |
| Alkyl Benzenes | 27.30 | 60.65 | 19.74 | 12.71 | 8.96 | 9.56 |
| Mononaphthene Benzenes | 20.95 | 26.45 | 25.82 | 19.70 | 14.18 | 12.30 |
| Dinaphthene Benzenes | 18.30 | 5.73 | 23.22 | 24.71 | 22.77 | 19.86 |
| Naphthalenes | 8.87 | 3.97 | 9.31 | 10.35 | 10.00 | 10.68 |
| Acenaphthenes | 7.87 | 1.65 | 7.66 | 10.07 | 11.47 | 11.40 |
| Fluorenes | 6.88 | 0.85 | 5.89 | 8.72 | 11.22 | 11.95 |
| Phenanthrenes | 3.82 | 0.35 | 2.50 | 4.21 | 6.23 | 7.50 |
| Naphthenephenanthrenes | 0.69 | 0.03 | 0.06 | 0.79 | 1.88 | 2.59 |
| Pyrenes | 0.45 | 0.00 | 0.30 | 0.73 | 1.24 | 1.64 |
| Chrysenes | 0.31 | 0.00 | 0.20 | 0.91 | 1.05 | 0.85 |
| Perylenes | 0.29 | 0.00 | 0.02 | 0.14 | 0.65 | 1.18 |
| Dibenzanthracenes | 0.17 | 0.00 | 0.05 | 0.11 | 0.26 | 0.58 |
| Benzothiophenes | 0.41 | 0.00 | 2.07 | 2.03 | 1.48 | 0.99 |
| Dibenzothiophenes | 0.80 | 0.00 | 0.73 | 1.68 | 2.44 | 2.05 |
| Naphthobenzothiophenes | 0.00 | 0.00 | 0.00 | 0.00 | 0.05 | 0.40 |
| Unidentifiable Aromatics | 2.90 | 0.32 | 1.81 | 3.16 | 6.11 | 6.47 |
| | 100.00 | 100.00 | 100.00 | 100.00 | 100.00 | 100.00 |
| Summary From Mass Spec Plus Silica Gel Analysis | | | | | | |
| Saturates (wt. % on Total) | | | | | | |
| Paraffins | 19.10 | 36.88 | 4.28 | 1.32 | 0.12 | 1.34 |
| 1-2 Ring | 36.37 | 49.89 | 42.97 | 27.86 | 13.62 | 15.70 |
| 3-6 Ring | 24.38 | 3.30 | 27.05 | 41.14 | 53.15 | 47.37 |
| Mono-aromatics | 0.74 | 0.64 | 0.99 | 1.07 | 1.52 | 1.58 |
| Aromatics (wt. % on Total) | | | | | | |
| Single Ring | 10.32 | 7.33 | 14.24 | 13.54 | 12.07 | 11.39 |
| Multi-Ring | 4.55 | 0.54 | 5.38 | 8.54 | 11.57 | 13.21 |
| Sulphur | 0.19 | 0.00 | 0.70 | 0.88 | 1.04 | 0.94 |
| Unidentifiable Aromatics | 0.45 | 0.03 | 0.37 | 0.75 | 1.61 | 1.77 |
| Polar Compounds | 3.90 | 1.40 | 4.00 | 4.90 | 5.30 | 6.7 |
| (wt. % on Total) | | | | | | |
| Total | 100.00 | 100.00 | 99.98 | 100.00 | 100.00 | 100.00 |

[a]The wt. % recovery is adjusted to 100.0% by proportional adjustments to each fraction.

TABLE VII

ANALYSIS OF EXPERIMENTAL PARAFFINIC SOLVENT 60 N THERMAL DIFFUSION FRACTIONS[a]

| | Feed | Port #3 | Port #8 | Port #9 | Port #10 |
|---|---|---|---|---|---|
| Silica Gel Analysis | | | | | |
| Saturates, wt. % | 80.0 | 91.3 | 71.6 | 64.3 | 55.7 |
| Aromatics, wt. % | 18.4 | 8.2 | 26.3 | 33.1 | 40.4 |
| Polar Compounds, wt. % | 1.6 | 0.5 | 2.0 | 2.5 | 3.9 |
| Recovery, wt. % | 100.0 | 100.0 | 99.9 | 99.9 | 100.0 |
| Mass Spec Analysis | | | | | |
| Saturates (LV % on Saturates) | | | | | |
| Paraffins | 29.52 | 48.49 | 6.17 | 2.98 | 1.79 |
| 1-Ring | 28.28 | 36.58 | 21.37 | 9.49 | 4.18 |
| 2-Ring | 21.69 | 12.66 | 37.39 | 25.59 | 13.26 |
| 3-Ring | 12.84 | 1.17 | 27.11 | 37.22 | 28.69 |
| 4-Ring | 7.66 | 0.93 | 5.88 | 19.68 | 36.33 |
| 5-Ring | 0.00 | 0.00 | 2.07 | 5.05 | 15.75 |
| 6-Ring | 0.00 | 0.00 | 0.00 | 0.00 | 0.00 |
| Mono-aromatics | 0.00 | 0.16 | 0.00 | 0.00 | 0.00 |
| | 100.00 | 100.00 | 100.00 | 100.00 | 100.00 |
| Aromatics (LV % on Aromatics) | | | | | |
| Alkyl Benzenes | 30.34 | 78.62 | 16.39 | 8.79 | 5.64 |
| Mononaphthene Benzenes | 22.74 | 14.05 | 31.81 | 21.85 | 13.26 |
| Dinaphthene Benzenes | 19.05 | 1.83 | 23.51 | 33.04 | 31.08 |
| Naphthalenes | 8.81 | 2.75 | 11.47 | 9.72 | 10.04 |
| Acenaphthenes | 5.97 | 1.53 | 6.17 | 9.18 | 10.48 |
| Fluorenes | 4.46 | 0.28 | 3.89 | 6.69 | 10.48 |
| Phenanthrenes | 1.58 | 0.37 | 1.31 | 2.35 | 3.70 |
| Naphthenephenanthrenes | 0.16 | 0.10 | 0.00 | 0.26 | 1.20 |
| Pyrenes | 1.15 | 0.42 | 1.15 | 1.32 | 1.47 |

TABLE VII-continued

ANALYSIS OF EXPERIMENTAL PARAFFINIC SOLVENT 60 N THERMAL DIFFUSION FRACTIONS[a]

| | Feed | Port #3 | Port #8 | Port #9 | Port #10 |
|---|---|---|---|---|---|
| Chrysenes | 0.34 | 0.00 | 0.00 | 0.44 | 1.20 |
| Perylenes | 0.09 | 0.03 | 0.00 | 0.01 | 0.45 |
| Dibenzanthracenes | 0.01 | 0.00 | 0.01 | 0.01 | 0.02 |
| Benzothiophenes | 3.10 | 0.00 | 4.28 | 2.85 | 2.28 |
| Dibenzothiophenes | 1.47 | 0.00 | 0.00 | 3.28 | 5.83 |
| Naphthobenzothiophenes | 0.04 | 0.00 | 0.00 | 0.00 | 0.31 |
| Unidentifiable Aromatics | 0.68 | 0.02 | 0.01 | 0.22 | 2.56 |
| | 100.00 | 100.00 | 100.00 | 100.00 | 100.00 |
| Summary From Mass Spec Plus Silica Gel Analysis | | | | | |
| Saturates (wt. % on Total) | | | | | |
| Paraffins | 22.62 | 44.27 | 4.42 | 1.92 | 1.00 |
| 1-2 Ring | 39.98 | 44.96 | 42.07 | 22.56 | 9.71 |
| 3-6 Ring | 16.40 | 1.92 | 25.10 | 39.83 | 44.99 |
| Mono-aromatics | 0.00 | 0.15 | 0.00 | 0.00 | 0.00 |
| Aromatics (wt. % on Total) | | | | | |
| Single Ring | 13.27 | 7.75 | 18.86 | 21.08 | 20.19 |
| Multi-Ring | 4.15 | 0.45 | 6.31 | 9.92 | 15.77 |
| Sulphur | 0.85 | 0.00 | 1.13 | 2.03 | 3.40 |
| Unidentifiable Aromatics | 0.13 | 0.00 | 0.00 | 0.07 | 1.83 |
| Polar Compounds (wt. % on Total) | 1.60 | 0.50 | 2.00 | 2.50 | 3.90 |
| Total | 100.00 | 100.00 | 99.89 | 99.91 | 99.99 |

[a]The wt. % recovery is adjusted to 100.0% by proportional adjustments to each fraction.

TABLE VIII

ANALYSIS OF NAPHTHENIC SOLVENT 60 N THERMAL DIFFUSION FRACTIONS[a]

| | Feed | Port #3 | Port #9 | Port #10 |
|---|---|---|---|---|
| Silica Gel Analysis | | | | |
| Saturates, wt. % | 80.7 | 93.3 | 62.8 | 57.1 |
| Aromatics, Wt. % | 17.6 | 5.9 | 34.0 | 38.4 |
| Polar Compounds, wt. % | 1.7 | 0.8 | 3.1 | 4.5 |
| Recovery, wt. % | 100.0 | 100.0 | 99.9 | 100.0 |
| Mass Spec Analysis | | | | |
| Saturates (LV % on Saturates) | | | | |
| Paraffins | 34.57 | 56.81 | 2.44 | 1.03 |
| 1-Ring | 25.80 | 33.06 | 9.40 | 3.29 |
| 2-Ring | 17.42 | 8.11 | 21.99 | 10.68 |
| 3-Ring | 10.29 | 0.80 | 28.53 | 34.50 |
| 4-Ring | 8.21 | 0.70 | 27.43 | 32.91 |
| 5-Ring | 3.71 | 0.34 | 10.21 | 17.54 |
| 6-Ring | 0.00 | 0.00 | 0.00 | 0.00 |
| Mono-aromatics | 0.00 | 0.17 | 0.00 | 0.06 |
| | 100.00 | 100.00 | 100.00 | 100.00 |
| Aromatics (LV % on Aromatics) | | | | |
| Alkyl Benzenes | 29.31 | 79.96 | 9.67 | 5.82 |
| Mononaphthene Benzenes | 20.28 | 13.32 | 18.48 | 12.22 |
| Dinaphthene Benzenes | 18.20 | 1.51 | 27.82 | 27.05 |
| Naphthalenes | 9.01 | 2.76 | 10.33 | 10.45 |
| Acenaphthenes | 7.40 | 1.33 | 10.91 | 12.44 |
| Fluorenes | 5.74 | 0.22 | 8.60 | 11.36 |
| Phenanthrenes | 2.20 | 0.24 | 3.42 | 4.43 |
| Naphthenephenanthrenes | 0.35 | 0.00 | 0.39 | 1.17 |
| Pyrenes | 0.96 | 0.44 | 0.89 | 1.02 |
| Chrysenes | 0.93 | 0.02 | 1.46 | 1.61 |
| Perylenes | 0.16 | 0.00 | 0.05 | 0.66 |
| Dibenzanthracenes | 0.01 | 0.00 | 0.00 | 0.03 |
| Benzothiophenes | 1.62 | 0.00 | 2.27 | 1.68 |
| Dibenzothiophenes | 2.37 | 0.00 | 4.35 | 6.17 |
| Naphthobenzothiophenes | 0.09 | 0.05 | 0.00 | 0.33 |
| Unidentifiable Aromatics | 1.38 | 0.17 | 1.35 | 3.58 |
| | 100.00 | 100.00 | 100.00 | 100.00 |
| Summary From Mass Spec Plus Silica Gel Analysis | | | | |
| Saturates (wt. % on Total) | | | | |
| Paraffins | 27.90 | 53.00 | 1.53 | 0.59 |
| 1-2 Ring | 34.88 | 38.41 | 19.71 | 7.98 |
| 3-6 Ring | 17.92 | 1.72 | 41.55 | 48.51 |
| Mono-aromatics | 0.00 | 0.16 | 0.00 | 0.03 |
| Aromatics (wt. % on Total) | | | | |
| Single Ring | 11.93 | 5.59 | 19.03 | 17.31 |
| Multi-Ring | 4.71 | 0.30 | 12.26 | 16.58 |
| Sulphur | 0.72 | 0.00 | 2.25 | 3.14 |
| Unidentifiable Aromatics | 0.24 | 0.01 | 0.46 | 1.37 |
| Polar Compounds (wt. % on Total) | 1.70 | 0.80 | 3.10 | 4.50 |

TABLE VIII-continued

| ANALYSIS OF NAPHTHENIC SOLVENT 60 N THERMAL DIFFUSION FRACTIONS[a] | | | | |
|---|---|---|---|---|
| | Feed | Port #3 | Port #9 | Port #10 |
| Total | 100.00 | 99.99 | 99.89 | 100.01 |

[a]The wt. % recovery is adjusted to 100.0% by proportional adjustments to each fraction.

What is claimed is:

1. In the method of operating a traction drive the improvement comprising using as the traction fluid a fluid having a lubricant basestock comprising a selected mineral oil composition which contains a saturate fraction having at least about 35% by volume of multiring components of at least three rings and an aromatic fraction which comprises at least about 15% by weight of said composition and wherein the weight ratio of aromatic fraction to saturate fraction is at least about 0.2:1, said aromatic fraction containing at least about 40% by volume of multiring components having two or more rings at least one of which is an aromatic ring, said traction fluid having a viscosity of at least about 40 cSt at 30° C. and a Traction Index of at least about 0.65.

2. The method of claim 1 wherein said aromatic fraction comprises at least about 20% by weight of the composition.

3. The method of claim 2 wherein the saturate fraction has a volume ratio of at least about 0.5:1 multiring to 1–2 ring components.

4. The method of claim 3 wherein said traction index is at least about 0.75.

5. The method of claim 4 wherein said saturate fraction has a volume ratio of at least about 1:1 multiring to 1–2 ring components.

6. The method of claim 4 wherein said fluid has a viscosity of at least about 50 cSt at 30° C.

7. The method of claim 5 wherein said aromatic fraction contains at least about 60% by volume of multiring components.

8. The method of claim 7 wherein said aromatic fraction comprises at least about 25% by weight of the composition.

9. The method of claim 8 wherein said saturate fraction has a volume ratio of at least about 2:1 multiring to 1–2 ring components.

10. The method of claim 9 wherein the weight ratio of aromatics to saturates is at least about 0.3:1.

11. The method of claim 10 wherein said fluid has a viscosity of at least about 50 cSt at 30° C.

12. The method of claim 11 wherein said aromatic fraction contains at least about 80% by volume of multiring components.

13. The method of claim 12 wherein said aromatic fraction comprises naphthalenes, acenaphthenes, fluorenes, phenanthrenes, mononaphthene benzenes, and dinaphthene benzenes.

14. The method of claim 12 wherein the weight ratio of aromatics to saturates is at least about 0.4:1.

* * * * *